United States Patent [19]

Li

[11] Patent Number: 4,832,074

[45] Date of Patent: May 23, 1989

[54] AUTOMATIC WATER HOSE REWINDER

[76] Inventor: Wen-Kuang Li, No. 11, Alley 100, Lane 61, Nei-Hu Rd., Sec. 1, Taipei, Taiwan

[21] Appl. No.: 199,097

[22] Filed: May 26, 1988

[51] Int. Cl.[4] ..... A62C 35/00

[52] U.S. Cl. ..... 137/355.2; 137/355.26

[58] Field of Search ..... 137/355.26, 355.2, 355.16; 242/86.2

[56] References Cited

U.S. PATENT DOCUMENTS

| | | | |
|---|---|---|---|
| 1,746,995 | 2/1930 | Edwards | 137/355.26 |
| 2,301,208 | 11/1942 | Gear | 137/355.2 |
| 2,339,668 | 1/1944 | Baldwin et al. | 137/355.2 |
| 2,496,489 | 2/1950 | Palm | 137/355.2 |
| 2,595,655 | 5/1952 | Honnay | 137/355.2 |
| 2,606,067 | 8/1952 | Roark | 137/355.2 |
| 4,534,384 | 8/1985 | Graham et al. | 137/355.2 |

*Primary Examiner*—Michael Chambers

*Attorney, Agent, or Firm*—Ostrolenk, Faber, Gerb & Soffen

[57] ABSTRACT

An automatic water hose rewinder includes mainly a completed cabinet, and inner of the cabinet contains a reel which can be driven by motor or operated by manual action. Winding the hose is via a small rolling wheel's outlet hole which is designed to reduce friction and then via a hose arranging device to move between the rollers in rows neatly, and the hose is pressed tightly to avoid loosening by presshose device. When the hose is pulled out for using, it is disengaged away the motor and pulled with ease. Besides, while cutting off the electricity, the hose can be also rewinded into the said reel by manual rotation and caused the same effect of arranging in rows neatly by the function of hose arranging device and of tightening by presshose device.

8 Claims, 4 Drawing Sheets

A-A' SECTION

F-F SECTION

E-E SECTION

E-E SECTION

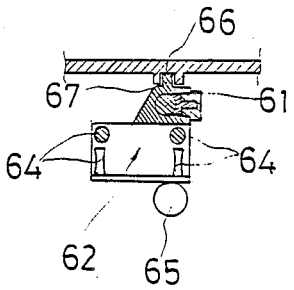
D-DSECTION
FIG.8
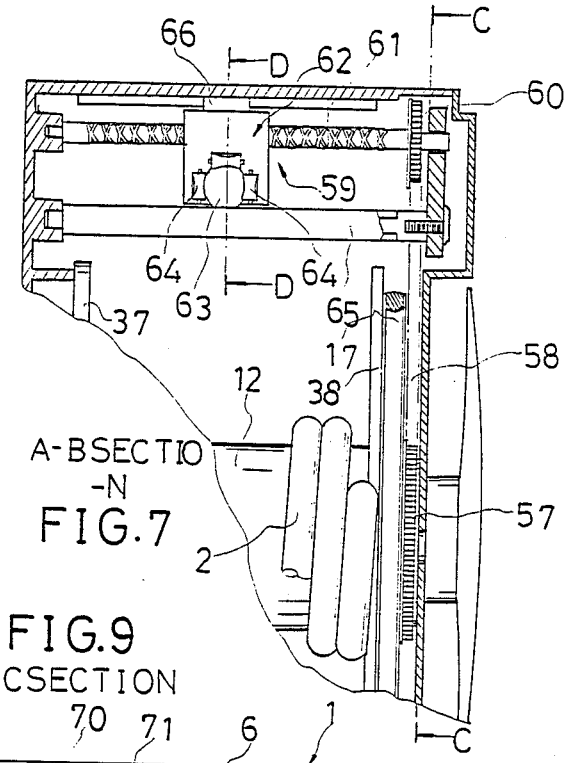
A-BSECTIO
-N
FIG.7
FIG.9
C-CSECTION
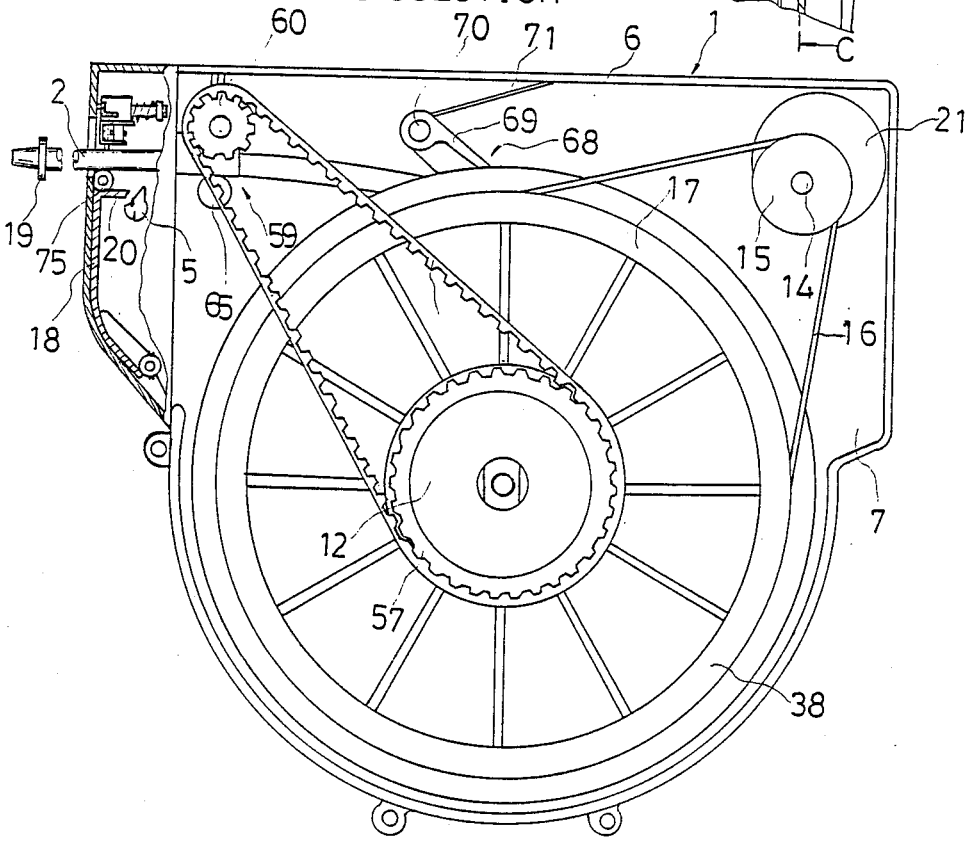

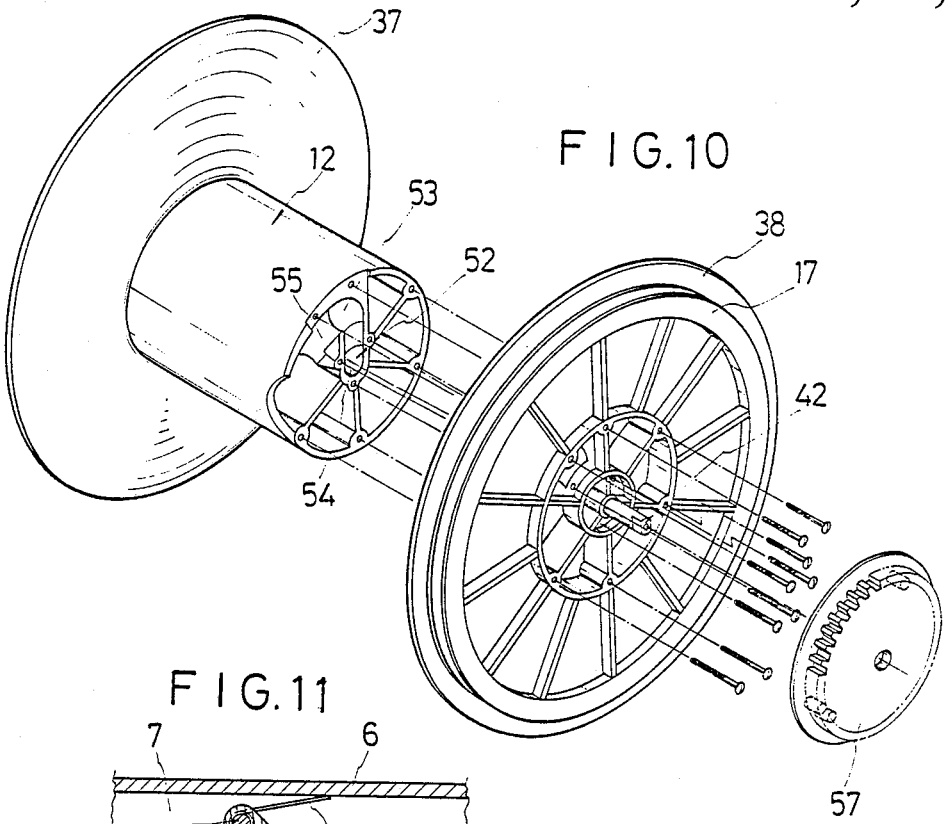
FIG. 10
FIG. 11
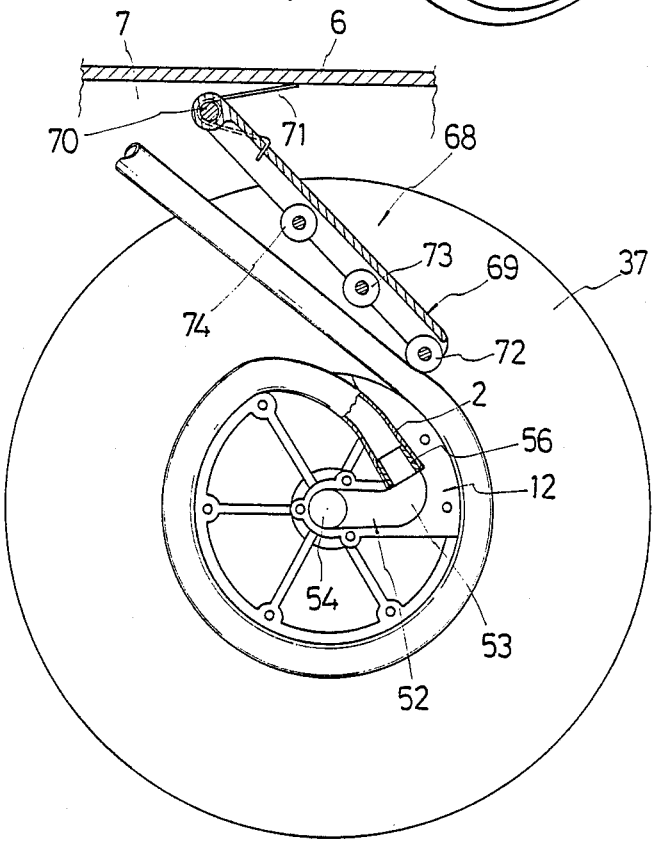

AUTOMATIC WATER HOSE REWINDER

FIELD OF THE INVENTION

The present invention relates to an automatic water hose rewinder which can be connected with a water source and wherein the water hose can be pulled out to the place of use. This present apparatus adapts to gardening, car washing and other multifunction. Rewinding is automatic. It is only necessary to press the switch after working, and the hose which has been pulled out for use will cut off automatically the motor's electrical source at the end of rewind.

BACKGROUND OF THE INVENTION

The general extension hose for hoseholding is always dragged on the dirty and wet ground, and it is difficult for keep clean after working. That is why the present automatic water hose rewinder is invented. Referring to the prior art, there is the U.S. Pat. No. 4,513,772 which is the best prior example so far. According to the aforesaid prior art, its reel is placed between two parallel end-boards; however, some partial devices are exposed outside of the two end-boards, such as motor, gearing wheel, clutch, etc.; two-thirds of its top parts and all of its front parts are opening. This design can easily cause accidents because of the children's closing in family. Although the structure of the prior art has a hose arranging device and a clutch device, yet there is no means for reducing friction to the hose passing position. For the reason the hose has a short life. Besides, the clutch structure is complex, and the apparatus which is operated by manual action and exposed completely to the outside of end-boards is easily stained and difficult for maintenance. The hose's unit connection is flanged outside its reel and is not smooth after rewinding. Unfortunately, there is no leak preventing device for the hose's unit connection so that causes the disadvantages of water leakage and disengagement.

The design of present invention when compared with U.S. Pat. Nos. 3,394,730; 2,606,067; 2,573,868; 1,746,995 fails to show any structures similar to the present invention.

OBJECTS OF THE INVENTION

It is the object of the present invention to solve the defects of the afore-said conventional hose rewinder and to supply a new hose rewinder which is safe, has long hose life, is easily operated and conveniently maintained. All of the means of the present invention are placed in its cabinet for keeping safe exactly. The friction of the hose's input and output directly are all rolling friction to reduce the friction force and to increase the life of the hose. Besides, utilizing the reverse function of simple gear wheel and motor raises the clutch's effect. It is convenient to operate.

It is still a further object of the present invention to adapt the design of unit connection inside the reel for the connecting of reel and hose. The structure will not be flanged outside the reel and will not make the hose un-smooth, the structure will not have the problems of disengagement and water leakage because utilizes the design of conic connection.

Still other objects and functions of the present invention are referred to in the best practical examples and drawings and described in the SPECIFIC DESCRIPTION.

SUMMARY OF THE INVENTION

According to a broad aspect of the present invention, there comprises a completed cabinet. Between the cabinet's two parallel side boards' a reel is mounted to the center; also inside the cabinet a water input hose connects the hose outside of the cabinet and reel to guide water into the hose. The rear part under the top board carries a motor which can turn positively and reversely and its output shaft unites a clutch-functional gear wheel set to make motor and reel disengage or drive. About at the center of top board front of the motor has a water hose pressboard for reeling hose in rows neatly via its spring and arranged not to loosen automatically while pulling out the hose. The front of the said water pressboard carries a hose arranging device which is controlled by a screw rod's turning to make a hemicycle driver mesh the water hose to move to and fro between the said two side boards and via the function of the rolling shaft to reel the water hose smoothly in rows on the reel. It has to pull out the water hose for using by manual operation, and the reel's turning will not make the motor operate while pulling out the hose. Therefore, it is easy to pull and may pull out only the needed length. On the contrary, it is only required to press the switch after working, then it will reel the water hose automatically and at the end turn the motor in reverse to disengage the power with the reel and to cut off the electricity to wait for next using.

BRIEF DESCRIPTION OF THE DRAWING

FIG. 5 is in the condition of disengagement and FIG. 4 is of connection.

FIG. 7 is a partial cross-sectional view, taken along line A-B of FIG. 1 and illustrates the hose arranging device of the present invention.

FIG. 8 is a cross-sectional view, taken along line D—D in FIG. 7 and illustrates the positioning piece of the water hose driver extending into the guide slot of the top board and makes the water hose driver not turn as following the screw rod.

FIG. 9 is a partial cross-sectional view, taken along line C—C in FIG. 7 and shows the relative positions of motor, water hose pressboard hose arranging device and the structure of the electrical switch of motor.

FIG. 10 is on exploded view of the reel of the present invention and illustrates the form of the water hose's connected position.

FIG. 11 is a side view of water hose pressboard and of the connected end part of the water hose of the present invention.

SPECIFIC DESCRIPTION

Figure 1:
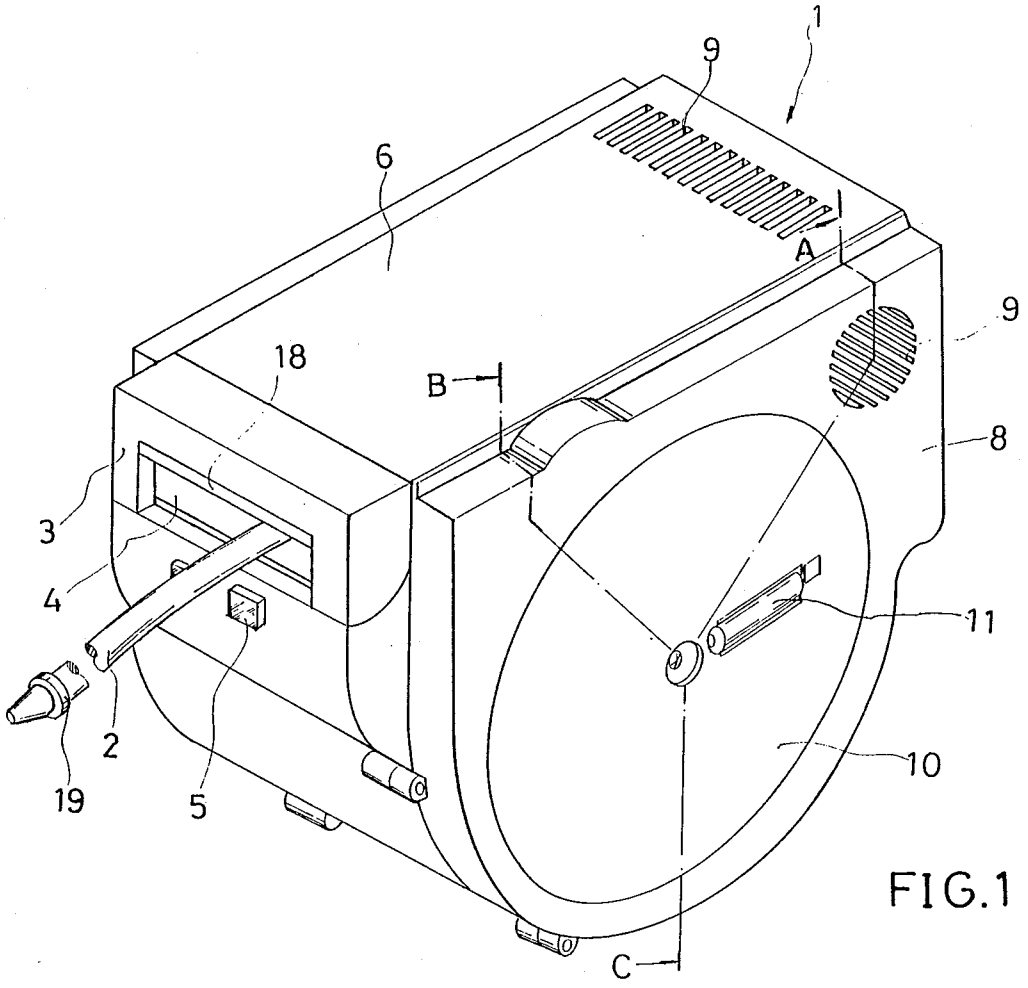
FIG. 1 is a perspective view of the present invention.

Referring to FIG. 1, all of the structures of the present invention are contained in the cabinet 1; the water hose 2 extends through outlet hole 4 of the front small cover 3. Electrical switch 5 is located at one side. The back of the top board 6 and right-board 8 carry air slots 9. At the center of said right-side cover 8 there is a side cover 10 which is united with a folded shake handle 11.

Figure 2:
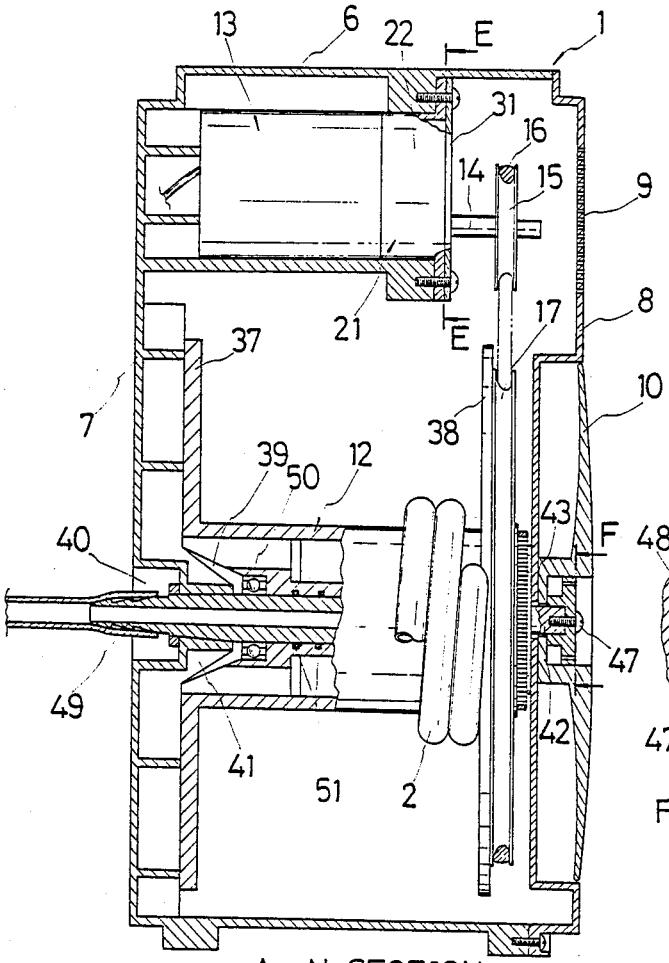
FIG. 2 is a partial cross-sectional view, taken along line A—A in FIG. 1 and illustrates the moter connected to the reel via belt, and shows the structure of water input hose inside.

According to FIGS. 2 and 9, at the bottom center between the left-side Board 7 and right-side board 8, these sides are connected by water hose reel 12; at the reel of top board 6 and left-side board 7 there is positioned motor 13 whose power-output shaft 4 connects with belt wheel 15 and unites belt wheel 17 of reel 12 via belt 16 to drive reel 12 rotating water hose 2 back. The said motor 13 is an A.C. motor which can turn positive and is reverse and controlled by the electrical switch 5. The inner structure of said electrical switch 5 is the same as a general bi-sectional switch, one side conducts the electrical source to motor's 13 positive rotation, and other one to motor's 13 reverse rotation, and its center is a cut-off position. The difference, however, is a screw spring installed between one side of the press-button of electrical switch 5 and the switch 19 and utilizing the end part of the water hose 2 to press the contact rod 20 of the frame 18 of the outlet hole 4. This end of the press-button hole 39 turns motor 13 reverse and springs back automatically and stops finally. The front of the said motor 13 carries clutch device 21 for motor's 13 power-output or running in idle.

Figure 4:
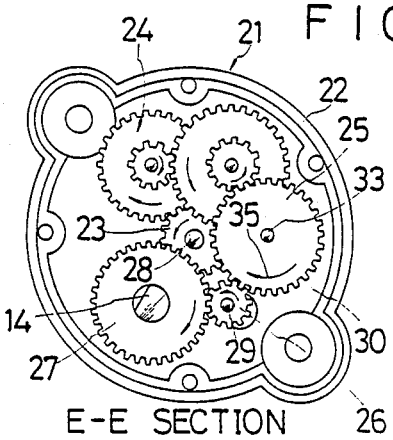
FIGS. 4 and 5 are also cross-sectional views, taken along line E—E in FIG. 2 and show the structure and function of the motor clutch device.
Figure 6:
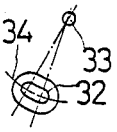
FIG. 6 shows the structure view of the clutch gear wheel in FIGS. 4 and 5.
Figure 5:
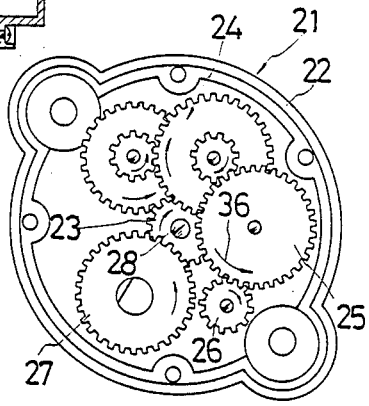

According to FIGS. 2, 4 and 5, the clutch device 21 of the said motor 13 is positioned in body 22 in front of motor 13, and it includes gear pinion 23, geared-down set 24, passive gear 25, clutch gear 26, output gear and so on. Gear pinion 23 is fixed on the motor shaft 28 and meshes the first gear of geared-down set 24 whose last one meshes passive gear 25, and passive gear 25 meshes clutch gear 26 whose shaft 29 sleeves actively on bottomboard 33 of body 22 and in arc slipping slot 32 of cover board 31. Referring to FIG. 6, the said slipping slot 32 is centered by shaft 33 of passive gear 25. A radius' distance which adds together the radius' of passive gear 25 and clutch gear 26 draws an arc line 34 equal to the center line of slipping slot 32. That will make clutch gear 26 and output gear 27 mesh together or disengage following the rotation direction of passive gear 25. The following the views of FIGS. 4 and 5, motor shaft 28 rotates reversely in FIG. 4 and makes passive gear 25 turn following the direction of arrow mark 35 and leads clutch gear 26 meshing output gear 27, and the power is put out by output shaft 14. According to FIG. 5, when motor shaft 28 rotates in positive direction, it drives passive gear 25 turning from the direction of arrow mark 36 and makes clutch gear 26 and output gear 27 disengage and output with powerless.

Figure 3:
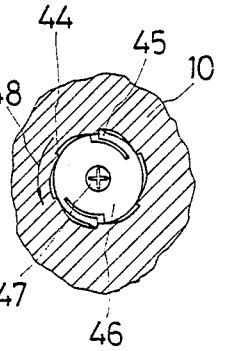
FIG. 3 is a partial cross-sectional view, taken along line F—F in FIG. 2 and illustrates the structure of reel shaft and right side cover.

Referring again to FIGS. 2 and 9, there are rim boards 37 and 38 between reel's 12 two sides of the present invention. Rim board 37 and 38 are both cycles and parallels. There is a conical shaft hole 39 at left of sleeve conical shaft 41 which is convex inward and placed above water input hole 40 of left-side board 7 and to be positioned. Shaft 42 is installed at right through the right-side board's shaft hole 43 to unite right-side cover 10. At the center of said right-side cover 10 is a concave inward cycle hole whose inner rim is the inner ratchet-gear wheel 44 (see FIG. 3). The end of shaft 42 is coupled with mat piece 46 which has ratchet pawl 45 and is locked to the end of shaft 42 by screw bolt 47. Therefore, it may be operated by manual action to turn shake handle 11 above right-side cover 10 (see FIG. 1) and make right-side cover 10 rotate. If, however, it is according to the direction of arrow mark 48 (reverse the time direction) to turn right-side cover 10, ratchet pawl 45 will slide over from the ratchet gear, that is the cover face runs in idle in order to prevent messing up the water hose above reel 12. On the contrary, if it is according to the reverse direction of arrow mark 48 (following the time direction) to turn, ratchet pawl 45 will mesh ratchet-gear wheel 44 to make reel 12 turn back the water hose 2.

According to FIGS. 2, 10 and 11, at the center left of reel 12 carries a water input connection 49. When reel 12 is rotating, it can input water at the same time by pivoting bearing 50 and water seal rings 51. At right half part of reel 12 has an associate device 52 to unite water hose 2. There installs concave slot 53 above the traversing face of the reel and right rim board's 38 face to unite center water passage 54, and at the joint of concave slot 53 and water reel 2 there shows conic slot 55 to set into the end of water hose 2. The said end of water hose 2 is coupled with a section of conic hard hose 56 of which outter diameter is bigger than the inner diameter of water hose 2. Being squeezed into water hose 2, the end of hard hose 56 forms conical and is coupled with conic slot 55 and obliterated any water proof sealing glue about it. Then, it is coupled with right rim board 38 means to make the hose unite on the reel. Water hose 2 bears the pull as big as tight and not has the defect of water leakage, and it will be also smooth while reeling.

Referring again to FIGS. 7 and 9, at right of belt wheel 17 right of reel 2 there is a small belt wheel 57 turning as reel 12 turns. Belt 58 is coupled with belt wheel 60 of hose arranging device 59. The said belt wheel 60 is fixed on the end of drive screw rod 61 to turn as reel 12 does. Water hose driving piece 62 is screwed on the screw rod, whose bottom is a big hemicycle long hole 63. At the two ends' up rim and two side rims of the hole diameter have respectively small roll wheels 64 to reduce the friction with water hose 2 and to drive the passed water hose 2 through said hemicycle long hole 63 moving right and left and in rows neatly between two rim boards 37 and 38 of reel 12. The weight of water hose 2 which passes through hemicycle long hole 63 is born by roller 65 adjacent to the said hemicycle long hole 63. That makes driving piece 62 move actively on screw rod 61. Top of the said driving piece 62 has a positioning piece 66 which is set into guide slot 67 of top board 6 (see FIG. 8) to make the said driving piece 62 not turn as screw rod 61 does.

According to FIGS. 9 and 11, bottom of top board 6 back of the said whater hose arranging device 59, and between side boards 7 and 8, there pivot a presshose device 68 which comprises a pressboard 69, an journal 70 and two springs 71. Pressboard's 69 bottom rim pivots three rollers 72, 73 and 74 which can move by the measure of water hose 2 and force water hose 2 arranging in rows following the roller's process. End of pressboard 69 of which two ends sleeve respectively a spring. One end of the said spring presses on the top face of pressboard 69, and the other one touches to the bottom rim of top board 6 to make pressboard 69 has any suitable pressure.

According to FIG. 9, above front of small cover 3 couples a water hose outlet hole 4 of which hole's diameter down rim has several rolling wheels 75 to reduce the friction of moving out and in of water hose 2.

The present invention can be fixed on the wall about one meter above the ground and also placed on the ground for using. It needs only to connect water source and electrical source while using, then water hose 2 can be easily to pull out. Need how long and pull how long. Pressing switch 5 is the only act after working, then motor 13 will drive reel 12 to rewind slowly water hose 2 and to arrange water hose 2 in rows on reel 12 by the functions of hose arranging device 59 and presshose device 68. Finally, end of water hose 2 will press switch 5 which has a spring and then turn motor reversely and make passive gear 25 push away the clutch gear 26 and disengage the power and reel. At the same time the spring will spread to make switch 5 jump to its turn-off position and wait for next using. When the electricity is cut off, it can also use shake handle 11 of rightside cover 10 to turn side cover 10 and to reel slowly water hose 2 into reel 12. It will be the same not to drive motor 13 and also arrange water hose 2 in rows neatly by the functions of hose arranging device 59 and presshose device 68.

I claim:

1. A water hose support and rewinding device comprising:

a housing having two spaced apart supporting walls and a front wall between the supporting walls;

a single water hose;

a reel supported for rotation between said walls; said reel being adapted to carry the single water hose;

the front wall for said housing having an opening for said hose to pass through; said water hose having one graspable end and said hose passing through said opening and being pullable out through said opening while unwinding said reel; friction reducing bearings at said opening over which said hose may rub as it moves through said opening;

a water connection from the exterior of said housing to said reel; means for connecting the end of said hose that is opposite said one end to said reel and to said water connection;

an electric motor within said housing; said motor being connected with said reel and operable to drive said reel in a direction to wind up said hose, and an electric switch for operating said motor; said motor being arranged to permit said hose to be drawn out freely through said opening in said front wall;

a clutch for engaging and disengaging the connection between said motor and said reel, wherein said clutch is operable for breaking the connection when said hose is wound up on said reel;

means for spooling said hose on said reel in regularly successive turns; a press board having a journal supported at said supportive walls, and a spring for driving said press board toward said reel for providing pressure upon said hose being wound on said reel and to insure regular distribution of said hose along said reel.

2. The water hose support and rewinding device of claim 1, wherein said connection between the inner end of said water connection and said water hose comprises complementary engaging ends, one of which is conical in cross-section, to provide a friction connection with the other.

3. The water hose support and rewinding device of claim 1, comprising an output gear; a gear connection between said motor and said output gear; said output gear being connected to drive said reel;

said clutch including a fixed gear pinion and a first gear wheel engaged with said pinion, said motor having a driven shaft and said first gear wheel being located at said motor shaft; means between said first gear wheel and said output gear for selectively connecting and disconnecting said output gear from drive through said first gear wheel.

4. The water hose support and rewinding device of claim 1, comprising a plurality of rollers adjacent said opening for said hose to provide an antifriction bearing for said hose.

5. The water hose support and rewinding device of claim 1, further comprising a handle on one of said walls for moving said reel to rotate.

6. The water hose support and rewinding device of claim 5, wherein said one wall has an inward inlay and said handle is foldably attached to said one wall for folding inward.

7. The water hose support and rewinding device of claim 1, wherein said press board has a length extending from said journal thereof toward said hose on said reel, and said board including three rollers on the surface thereof facing toward said hose to keep pressure by said press board on said hose in balance.

8. The water hose support and rewinding device of claim 8, further comprising a ratchet and pawl connection in the cover for effecting one way free rotation of said reel and off running of said hose.

* * * * *